United States Patent [19]

Sugimoto et al.

[11] Patent Number: 4,854,137

[45] Date of Patent: Aug. 8, 1989

[54] PERFORATED BEAM APPARATUS

[75] Inventors: Isao Sugimoto, Mie; Tomoaki Kasai, Kurobe, both of Japan

[73] Assignees: Yoshida Kogyo K. K., Tokyo; Nissen Corporation, Aichi, both of Japan

[21] Appl. No.: 302,605

[22] Filed: Jan. 27, 1989

[30] Foreign Application Priority Data

Jan. 29, 1988 [JP] Japan ..... 63-9688[U]

[51] Int. Cl.[4] ..... D06B 5/18

[52] U.S. Cl. ..... 68/15; 68/189

[58] Field of Search ..... 68/15, 189

[56] References Cited

U.S. PATENT DOCUMENTS 3,635,056 1/1972 Sato et al. ..... 68/189
4,206,619 6/1980 Fukuroi et al. ..... 68/189 X
4,337,631 7/1982 Fukuroi et al. ..... 68/189

FOREIGN PATENT DOCUMENTS 29287 12/1964 Japan ..... 68/189

*Primary Examiner*—Philip R. Coe
*Attorney, Agent, or Firm*—Hill, Van Santen, Steadman & Simpson

[57] ABSTRACT

A perforated beam apparatus is disclosed for dyeing or otherwise treating fabric materials, the apparatus comprising a horizontally disposed treatment vessel and a perforated cylindrical beam mounted concentrically in the vessel, and adapted to wind thereon layers of cloth, tapes, yarns and the like. There are established a main suction stream and a sub-suction stream of treating liquor, both streams flowing from a treatment chamber and merging into a heat exchange chamber. A pressure reserve tank is mounted above the treatment vessel for regulating the pressure therein and taking up air bubbles entrained with the flow of treatment liquor.

5 Claims, 2 Drawing Sheets

PERFORATED BEAM APPARATUS

BACKGROUND OF THE INVENTION

1. Field of the Invention

This invention relates to improvements in and relating to a perforated cylindrical beam apparatus for dyeing or otherwise treating fabrics in the form of cloth, tapes, yarns and other elongate materials.

2. Prior Art

Attempts have been made in providing means of achieving uniform distribution of a treatment liquor through the layers of fabric both axially and radially of the beam on which the fabric is wound. One such attempt is disclosed in Japanese Patent Publication No. 58-5301 in which a horizontally mounted beam apparatus is provided with flow communication ports at the upper front end and at the central lower portion of a partly dually structured treatment vessel in which the beam is accommodated, the ports being connected to piping, heat exchanger and pump all installed externally of the apparatus. This prior apparatus however has a drawback in that the apparatus as a whole becomes bulky and costly and requires complicated, tedious maintenance work.

SUMMARY OF THE INVENTION

With the foregoing difficulties of the prior art apparatus in view, the present invention seeks to provide an improved beam treatment apparatus which is ralatively compact and simple in construction and which is capable of treating fabric materials effectively and homogeneously.

This and other objects and features of the invention will appear apparent from reading the following detailed description with reference to the accompanying drawings which illustrate by way of example a preferred embodiment to which however the invention is in no way limited.

According to the invention, there is provided a perforated beam apparatus for dyeing or otherwise treating fabric materials which comprises: a horizontally mounted cylindrical treatment vessel having a dished end cover at one end and a rear end wall at the opposite end; a perforated cylindrical beam concentrically mounted within the treatment vessel and provided at opposite ends with outwardly extending annular rims defining therebetween a material winding zone in which the fabric is wound on the beam; a vertically disposed partition disc member having a pair of diametrically opposed peripheral recesses and defining with the rear end wall of the vessel a heat exchange chamber, separating this chamber from a treatment chamber extending the majority of the beam length; a pair of perforated flow rectifier plates fitted respectively in the peripheral recesses and extending horizontally between the disc member and the inlet end of the vessel and defining with the inner wall of the vessel an upper and a lower flow rectifier zone, the rectifier plates being spaced apart from the outer surface of the fabric on the beam; a recycle pump for feeding a treatment liquor through a feed tube extending horizontally into the interior of the beam; and a pressure reserve tank communicating with the interior of the vessel and supported in position above the upper rectifier zone.

DETAILED DESCRIPTION OF THE INVENTION

Figure 1:
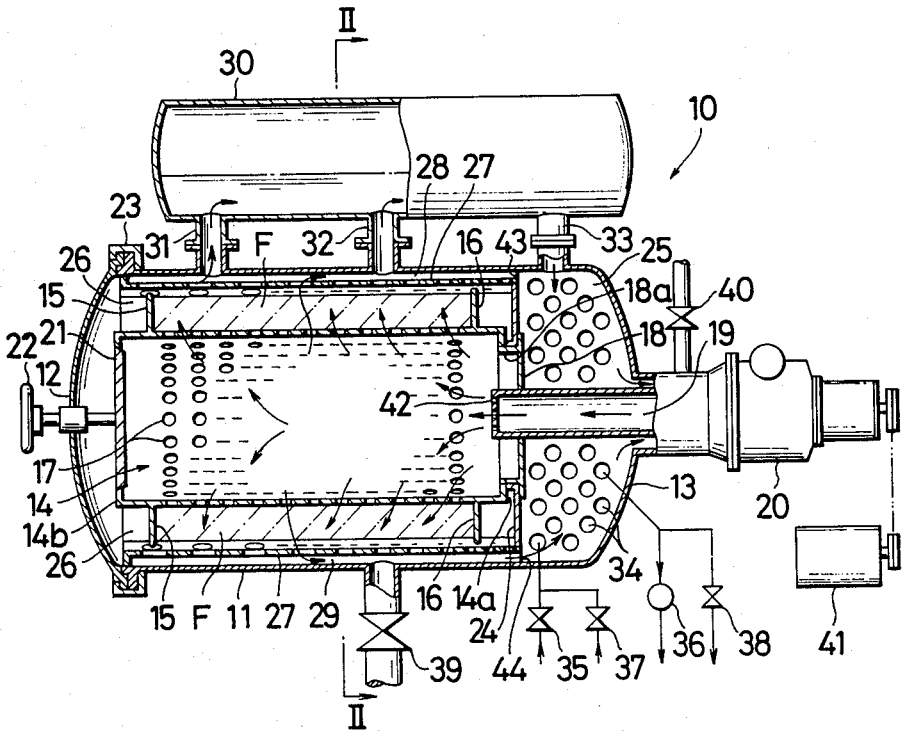
FIG. 1 is an elevational, partly sectional, view of a beam treatment apparatus embodying the invention.

Referring now to the drawings and FIG. 1 in particular, there is shown a beam dyeing or treating apparatus 10 for dyeing or otherwise treating woven or knitted fabrics F in the form of cloth, tapes, yarns and other elongate materials. The apparatus 10 comprises a horizontally mounted cylindrical treatment vessel 11 having a circular cross section (FIG. 2) and provided at one or front end with an outwardly dished end cover 12 and at the opposite or rear end with a similarly dished end wall 13.

Designated at 14 is a perforated cylindrical beam concentrically mounted within the vessel 11 and having at opposite ends a pair of outwardly extending annular support rims 15 and 16 defining therebetween a material winding zone in which the fabric F is wound onto the beam body. The beam 14 has a multiplicity of perforations 17 formed in its periphery and uniformly distributed therearound so that treatment or dye liquor pumped into the interior of the beam passes out through the perforations 17 and wets the fabric F wound thereon. A vertically extending annular support flange 18 is provided adjacent to the rear end of the beam 14 for supporting a feed tube 19 horizontally extending from a recycling pump 20 through the flange 18 into the interior of the beam 14. The support flange 18 also serves to receive and fit with an inwardly directed annular rear end wall **14*a* of the beam 14**.

The beam 14 may be inserted into the vessel 11 as it is transported on a cradle (not shown) or a suspension device (not shown) until the rear end wall **14*a* of the beam 14 engages in sealing relation with a horizontal extension 18*a* of the flange 18. In this position, a sealing disc 21 is brought into sealing engagement with an inwardly directed annular front end wall 14*b* of the beam 14, the sealing disc being connected via dished end cover 12 to a handle 22 with which to manipulate the mounting and dimounting of the beam 14. The end cover 12 is clamped in place with respect to the treatment vessel 11 as its peripheral edge is sealingly received in a clamping member 23**.

Figure 2:
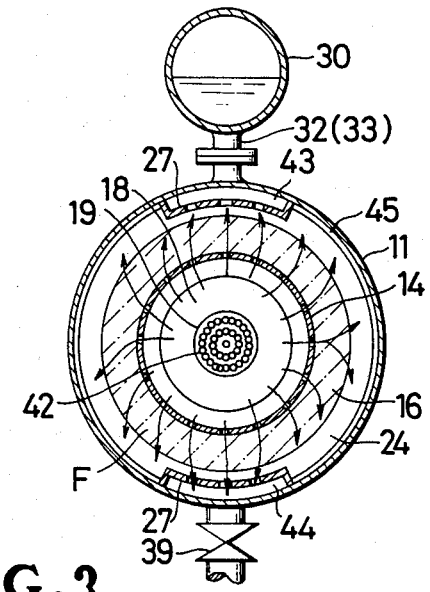
FIG. 2 is a cross-sectional view taken on the line II—II of FIG. 1.
Figure 3:
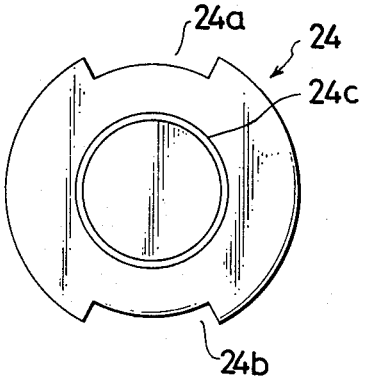
FIG. 3 is a plan view of a partition plate incorporated in the apparatus of FIG. 1.

Referring to FIG. 3, there is shown a vertically disposed flow rectifier partition disc member 24 having a pair of peripheral recesses **24*a*, 24*b* located in diametrically opposed positions and a concentric annular flange 24*c* of a diameter slightly smaller than that of the cylindrical beam 14. The partition disc 24 is fitted in place with its flange 24*c* engaged sealingly with the support flange 18 and defines with the dished rear end wall 13 of the vessel 11 a heat exchange chamber 25 and separates this chamber from a treatment chamber 26 extending the majority of the beam length. The two chambers are in flow communication with each other through an annular passageway for treatment liquor defined between the inner wall of the vessel 11 and the periphery of the partition disc 24 as seen in FIGS. 1 and 2**.

Figure 4:
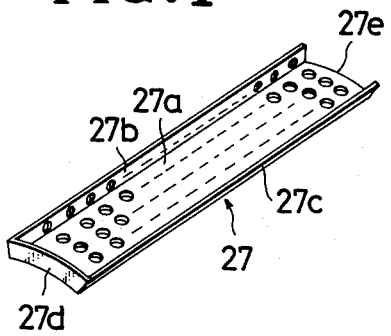
FIG. 4 is a perforated rectifier plate used in the apparatus of FIG. 1.

There is provided a perforated flow rectifier plate 27 which is in the form of a trough configured to fit in the recess 24*a* (24*b*) of the partition disc 24 and which extends horizontally between the disc 24 and the inlet end of the vessel 11. As better shown in FIG. 4, the perforated rectifier plate 27 comprises a base portion 27*a*, and upwardly directed opposed longitudinal edge portions 27*b*, 27*c* interconnected at one end by an unperforated end portion 27*d*, the opposite end 27*e* being left open to allow flow communication between the treatment chamber 26 and the heat exchange chamber 25. The unperforated end portion 27*d* of the plate 27 is welded or other affixed to the inner wall of the vessel 11 adjacent to the clamping member 23 at the front end of the vessel 11, whilst the open end portion 27*e* terminates at the partition disc 24 disposed adjacent to the rear end of the vessel 11 as shown in FIG. 1. In the illustrated embodiment, two of these rectifier plates 27 are provided, one of which defines with the inner wall of the vessel 11 a first or upper flow rectifier zone 28 and the other of which defines a second or lower flow rectifier zone 29, the two rectifier zones being disposed in diametrically opposed relation as better shown in FIG. 2. Each rectifier plate 27 extends in spaced apart or separated relation to the wound fabric F on the beam 14.

Designated at 30 is a pressure reserve tank supported externally on the treatment vessel 11 above the upper rectifier zone 28 by means of conduits 31, 32 and 33 through which the tank 30 is in flow communication with the interior of the vessel 11.

The pump 20 is a recycle pump capable of reversing the direction of flow of treatment liquor, a preferable example being disclosed in Japanese Publication No. 47-17106.

A heat exchange piping unit 34 is arranged in the heat exchange chamber 25 and connected to a steam inlet valve 35, a steam trap 36, a coolant inlet valve 37 and a coolant outlet valve 38. Designated at 39 is a liquor drain valve connected to the lower rectifier zone 29 in the vessel 11, and at 40 is a liquor feed valve connected to the feed tube 19 adjacent to the pump 20. The pump 20 is driven by a reversible motor 41.

The beam 14 with fabric F wound thereon having been mounted in position within the interior of the vessel 11, a dyeing or treatment liquor is introduced via feed valve 40 and pumped to pass in the direction of the arrows though the feed tube 19 and its perforated end baffle 42 into the interior of the beam 14 and continued to be fed until a predetermined level of liquor inventory is established in the tank 30, while steam of a predetermined temperature is supplied to the heat exchanger 34. The treating liquor is forced to pass outwardly through the perforations 17 of the beam 14 into the layers of fabric F and forms a main suction stream each in the upper and lower flow rectifier zones 28, 29 in the treatment chamber 26 leading through widened flow gates 43, 44 into the heat exchanger chamber 25 and a sub-suction stream elsewhere in the treatment chamber 26 leading through constructed circumferential flow gate 45 into the heat exchanger chamber 25. The main and sub-suction streams of liquor are thus merged in the heat exchanger chamber 25 and returned to the recycle pump 20 for recirculation into the beam 14. The main suction stream of liquor is oriented on entry to the respective rectifier zone (28, 29) to follow a substantially horizontal path and increases its speed gradually toward to widened flow gate (43, 44). Advantageously, since the rectifier plate 27 is isolated from the outer surface of fabric F on the beam 14, it is made possible to eliminate the turbulent flow of liquor which would otherwise occur in the vicinity of the support rim 16 on suction side, resulting in objectionable dye speckles or irregularities in the finish of fabric F.

Also advantageously, since the upper rectifier zone 28 is communicated through the conduits 31 and 32 with the tank 30 and the tank 30 is in turn communicated through the conduit 33 with the heat exchanger chamber 25, it is possible to eliminate air bubbles by suction into the tank 30 which would entrain with part of liquor stream passing out through the fabric F.

Further advantageously, it is possible to improve homogeniety or uniformity in the treatment finish of the fabric F particularly over the length thereof by increasing the porosity or pore volume per unit area of the perforated rectifier plate 27 progressively toward the unperforated end 27*d*.

If necessary as in treating fabric F of increased layered thickness the recycle pump 20 may be switched to reverse the direction of flow of the liquor so as to cause the liquor to be sucked from through the fabric F into the interior of the beam 14.

Experiments indicate that successful treatment can be achieved for example by design considerations in which the flow rates of liquor are allocated 50–60% at the upper rectifier zone 28; 30–50% at the lower rectifier zone 29; 10–15% at the constricted circumferential flow gate 45; and about 1/5 of the flow from the rectifier zone 25 into the tank 30.

Having thus described the invention, it is to be understood that various changes and modifications may be made in the specific constrution of the apparatus herein set forth, without departing from the scope of the appended claims.

What is claimed is:

1. A perforated beam apparatus for dyeing or otherwise treating fabric materials which comprises:

(a) a horizontally mounted cylindrical treatment vessel having a dished end cover at one end and a rear end wall at the opposite end;

(b) a perforated cylindrical beam concentrically mounted within said treatment vessel and provided at opposite ends with outwardly extending annular rims defining therebetween a material winding zone in which the fabric is wound on said beam;

(c) a vertically disposed partition disc member having a pair of diametrically opposed peripheral recesses and defining with the rear end wall of said vessel a heat exchange chamber, separating this chamber from a treatment chamber extending the majority of the beam length;

(d) a pair of perforated flow rectifier plates fitted respectively in said peripheral recesses and extending horizontally between said disc member and the inlet end of said vessel and defining with the inner wall of said vessel an upper and a lower flow rectifier zone, said rectifier plates being spaced apart from the outer surface of the fabric on the beam;

(e) a recycle pump for feeding a treatment liquor through a feed tube extending horizontally into the interior of said beam; and (f) a pressure reserve tank communicating with the interior of said vessel and supported in position above said upper rectifier zone.

2. Apparatus as claimed in claim 1, wherein said perforated flow rectifier plate is in the form of a trough configured to fit in the recess of said disc member and has one unperforated end affixed to the front end wall of said vessel and the opposite end open to allow flow communication between said treatment chamber and said heat exchange chamber.

3. Apparatus as claimed in claim 2, wherein said perforated flow rectifier plate has a pore volume per unit area progressively increasing toward its unperforated end.

4. Apparatus as claimed in claim 1, wherein said tank is communicated with said vessel through a plurality of conduits extending into said upper rectifier zone and said heat exchange chamber, respectively.

5. Apparatus as claimed in claim 1, wherein said recycling pump is operative to feed the treatment liquor in reversible directions of flow.

* * * * *